United States Patent [19]

Cohen et al.

[11] 4,399,943

[45] Aug. 23, 1983

[54] FLUID INJECTOR

[75] Inventors: Barry J. Cohen, Snodland; Joseph Scaramuzza; Graham Tock, both of Huddersfield, all of England

[73] Assignee: Peabody Holmes Limited, Huddersfield, England

[21] Appl. No.: 294,543

[22] Filed: Aug. 20, 1981

[30] Foreign Application Priority Data

Aug. 22, 1980 [GB] United Kingdom ..... 8027477

[51] Int. Cl.[3] ..... B05B 9/03

[52] U.S. Cl. ..... 239/125; 239/126

[58] Field of Search ..... 239/125, 126, 71, 533.2; 137/625.69, 614.06, 553, 554; 251/149.9

[56] References Cited

U.S. PATENT DOCUMENTS

| | | | |
|---|---|---|---|
| 2,753,927 | 7/1956 | Garraway | 239/126 |
| 3,844,479 | 10/1974 | Needham | 239/126 |

FOREIGN PATENT DOCUMENTS

| | | |
|---|---|---|
| 681800 | 10/1952 | United Kingdom . |
| 894575 | 4/1962 | United Kingdom . |
| 1231631 | 5/1971 | United Kingdom . |
| 1287448 | 8/1972 | United Kingdom . |
| 1497271 | 1/1978 | United Kingdom . |

*Primary Examiner*—John J. Love
*Assistant Examiner*—Jon M. Rastello
*Attorney, Agent, or Firm*—Richard D. Weber

[57] ABSTRACT

A fluid injector, for example for injecting liquid fuel into a combustion chamber, comprises a valve housing and an injector assembly which may be removably mounted on the valve housing. The injector assembly includes discharging means for discharging fluid from the injector assembly, ducting for conveying the fluid between the valve housing and the discharging means and a control valve movable to a first position in response to flow of the fluid in a first direction through the ducting to close the discharging means and return the fluid from the discharging means to the valve housing and movable to a second position in response to flow of the fluid in a second direction through the ducting to open the discharging means to allow at least some of the fluid conveyed to the discharging means to be discharged therefrom and to return any surplus fluid to the valve housing. Provided in the valve housing are inlet and outlet passages for conveying the fluid into and from the valve housing, and a change-over valve. The change-over valve comprises a valve member adjustable into a first position to condition the injector for flow of the fluid from the inlet passage through the ducting in said first direction and into a second position to condition the injector for flow of the fluid from the inlet passage through the ducting in said second direction. In the valve housing there is also provided a spill return valve for varying the proportion between the amount of the fluid that is allowed to discharge from the discharging means and the amount that is returned from the discharging means to the valve housing when the control valve is in its second position.

8 Claims, 9 Drawing Figures

FLUID INJECTOR

Figure 1:
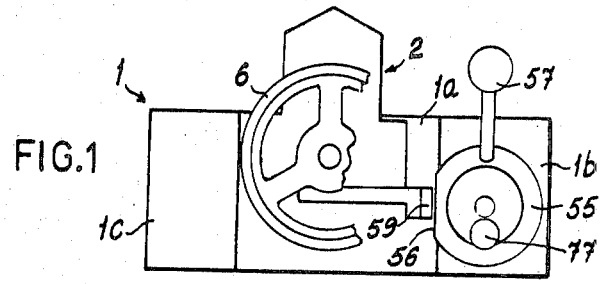

This invention relates to a fluid injector of the kind comprising a valve housing, an injector assembly including discharging means for discharging fluid from the injector assembly, ducting for conveying said fluid between the valve housing and said discharging means and a control valve movable to a first position in response to flow of said fluid in a first direction through said ducting to close said discharging means and return said fluid from said discharging means to the valve housing and movable to a second position in response to flow of said fluid in a second direction through said ducting to open said discharging means to allow at least some of the fluid conveyed to said discharging means to be discharged therefrom and to return any surplus fluid to the valve housing, inlet and outlet passages in said valve housing for conveying said fluid into and from the valve housing, and a changeover valve in the valve housing comprising a valve member adjustable into a first position to condition the injector for flow of said fluid from said inlet passage through said ducting in said first direction and into a second position to condition the injector for flow of said fluid from said inlet passage through said ducting in said second direction. In order to simplify the ensuing description, such fluid injectors will be called "fluid injectors of the kind referred to".

Fluid injectors of the kind referred to, which are known as spill return injectors, have been used for many years as part of liquid fuel burning equipment for boilers, a typical example of the use of such an injector for this purpose being described in British Patent Specification No. 681,800. Fluid injectors of the kind referred to can operate in one of two modes, depending on the position of said control valve. When the latter is in its said first position, the fluid simply circulates through said ducting from the valve housing to the discharging means and back to the valve housing, the injector then being said to be in its "circulate mode". In the case of an injector employed in liquid fuel burning equipment, the object of circulating liquid fuel through the injector is to keep the injector assembly, and particularly its discharging means, cool. When, on the other hand, the control valve is in its said second position, and fluid is discharged from said discharging means, the injector is said to be in its "discharge mode".

In the previously known fluid injectors of the kind referred to, a separate spill return valve is provided which can be used, when the injector is in its discharge mode, to vary the proportion between the amount of fluid that is allowed to discharge from the discharging means and the amount that is returned from the discharging means to the valve housing. This spill return valve has been arranged upstream of the change-over valve and has been connected with the change-over valve by piping.

The present invention aims to provide a fluid injector of the kind referred to which is of simpler construction compared with hitherto known fluid injectors of this kind.

According to the invention, in a fluid injector of the kind referred to, a spill return valve is provided in said valve housing for varying the proportion between the amount of fluid that is allowed to discharge from said discharging means and the amount that is returned from said discharging means to said valve housing when said control valve is in its said second position.

Thus, in a fluid injector in accordance with the invention, a single valve housing houses both the change-over valve and the spill return valve, enabling a very compact construction of the injector to be achieved.

In one embodiment of the fluid injector in accordance with the invention, the spill return valve has a linearly movable valve member and is interposed between said change-over valve and said ducting, i.e. downstream of the change-over valve. It is a simple matter to replace such a valve member with a differently dimensioned valve member to enable the injector to be used for different fluid quantity requirements.

Preferably, the valve member of the spill return valve is actuable by a pressure fluid-actuated piston and cylinder assembly, the valve member and the piston and cylinder assembly being spring biased so that, in the event of failure of the piston and cylinder assembly, the valve member is set automatically into a position in which the spill return from the discharging means is a maximum and the rate of fluid discharge from the discharging means is a minimum. Conveniently, the change-over valve of this embodiment of the injector also comprises a lineraly movable valve member which is actuable into at least one of said first and second positions under the control of a pressure fluid-actuated piston and cylinder assembly. It is then convenient to arrange that the axes of the linearly movable valve members of both the change-over valve and the spill return valve are substantially parallel to one another, and that the pressure fluid-actuated piston and cylinder assemblies of the two valve members are adjacent one another at one end of the valve housing.

Preferably, the spill return valve is provided with indicator means for indicating the position of the valve member of the spill return valve in the valve housing. This indicator means may be arranged to give an indication of the position of the valve member of the spill return valve at a location remote from the injector.

Figure 2:
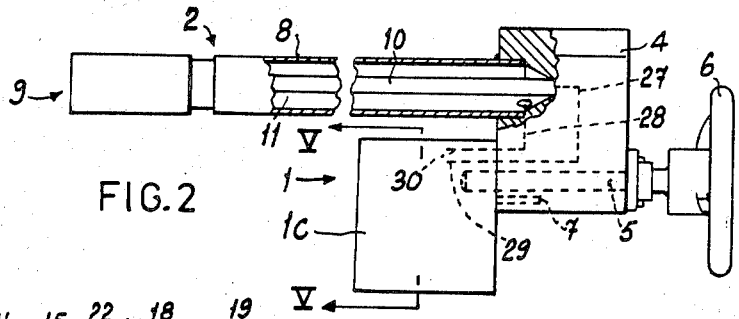
Figure 3:
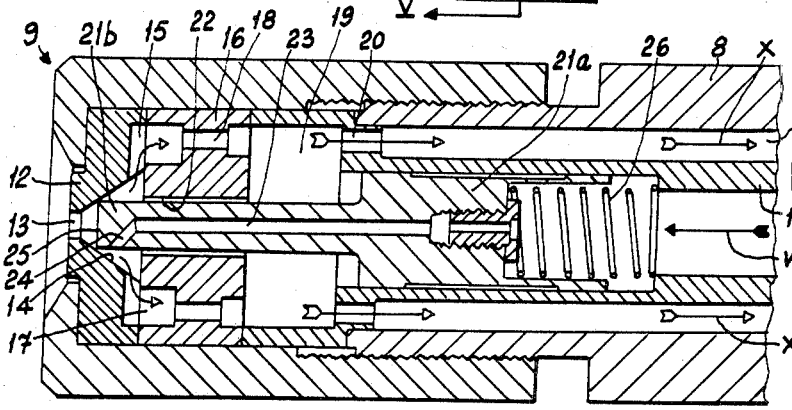
Figure 4:
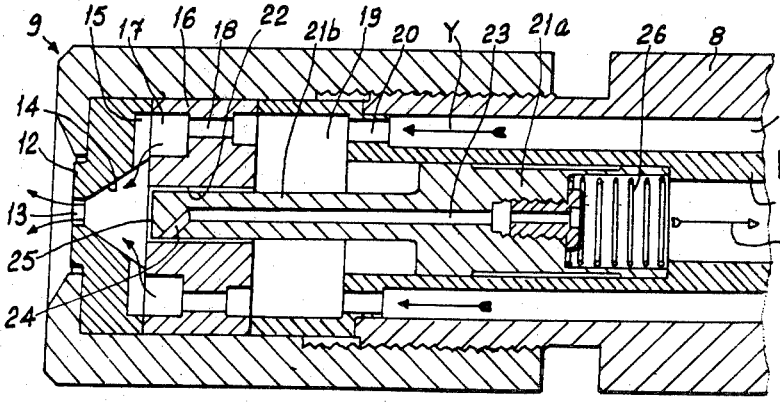
Figure 5:
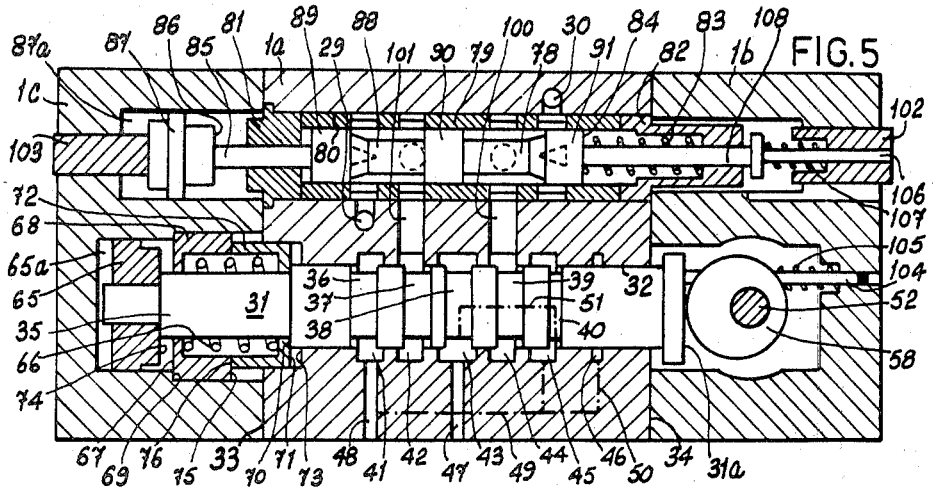
Figure 6:
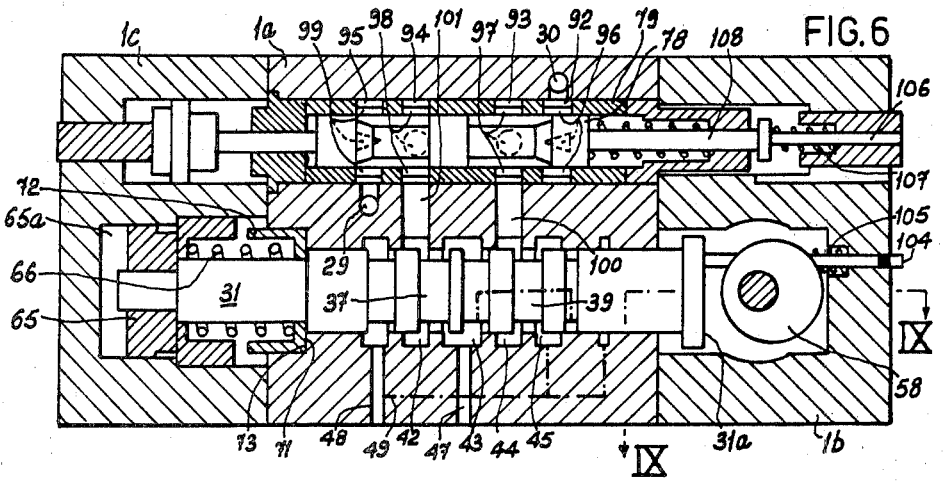
Figure 7:
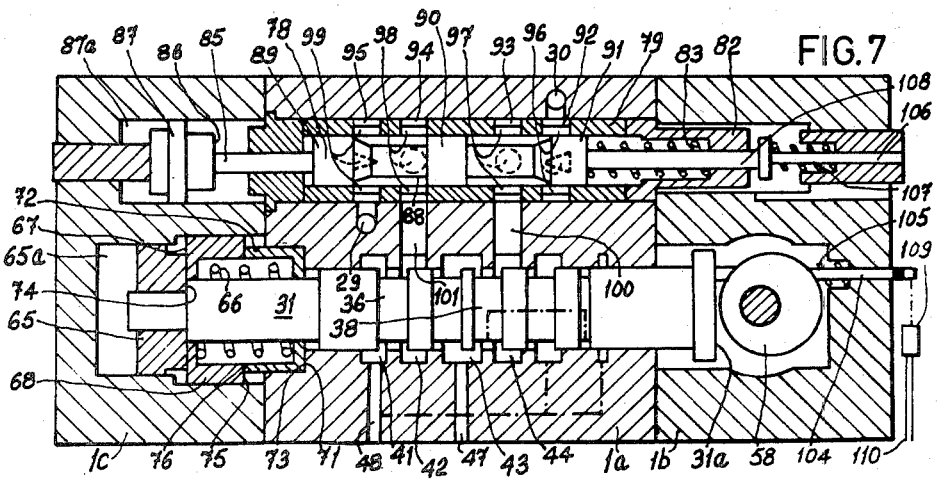
Figure 8:
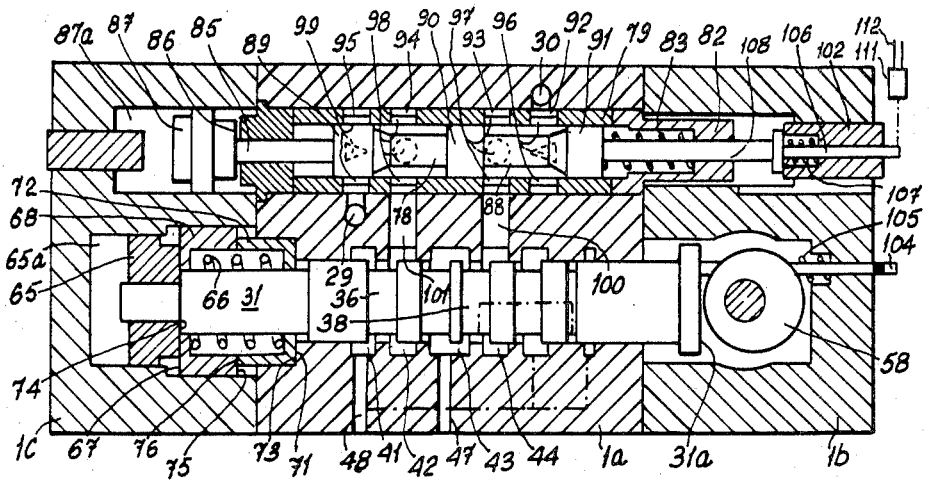
Figure 9:
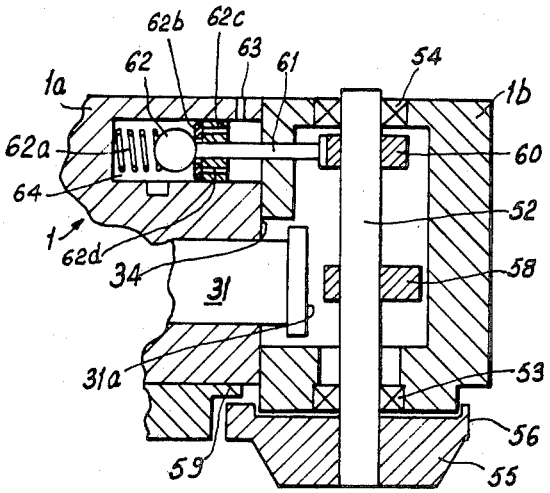

The invention will now be described, by way of example, with reference to the accompanying drawings, in which FIG. 1 is a schematic front view of one embodiment of a fluid injector in accordance with the invention, this injector being intended particularly for use as a liquid fuel injector in fuel burning equipment for a boiler, FIG. 2 is a partly sectioned side view corresponding to FIG. 1, FIG. 3 is a sectional view, on an enlarged scale, of part of the injector assembly of the injector of FIG. 1, the injector being in its circulate mode, FIG. 4 is a view similar to FIG. 3, but with the injector in its discharge mode, FIG. 5 is a sectional view, on an enlarged scale, of the valve housing and control means of the injector of FIGS. 1 and 2, taken on the line V—V of FIG. 2, the change-over valve being in its position corresponding to the isolate mode of the injector, FIG. 6 is a view similar to FIG. 5, but showing the change-over valve in its position corresponding to the circulate mode of the injector, FIG. 7 is a view similar to FIG. 5, but showing the change-over and spill return valves in positions corresponding to a low discharge mode of the injector, FIG. 8 is a view similar to FIG. 7, but showing the change-over and spill return valves in positions corresponding to a high discharge mode of the injector, and FIG. 9 is a sectional view taken on the line IX—IX of FIG. 6.

The liquid fuel injector shown in FIGS. 1 and 2 comprises a valve housing, generally designated by the numeral 1 and an injector assembly, generally designated by the numeral 2.

From FIG. 2, it will be seen that the injector assembly 2 comprises an injector housing 4 which is secured to the valve housing 1 by a bolt 5 connected to a handwheel 6. Accurate location of the injector housing 4 relative to the valve housing 1 is ensured by the engagement of pins 7, mounted on the housing 1, entering holes in the injector housing 4. When the handwheel 6 is rotated to unscrew the bolt 5, the pins 7 ensure that the injector housing 4 can only be moved away from the housing 1 in the direction of the longitudinal axes of the pins 7.

The injector assembly 2 comprises a tubular casing 8 secured to the housing 4 and a liquid discharging means in the form of an atomiser, generally designated by the numeral 9, at the free end of the casing 8 (see FIGS. 3 and 4). Within the casing 8 is a pipe 10, there being an annular duct 11 between the external surface of the pipe 10 and the internal wall of the casing 8. This pipe 10 and the annular duct 11 together form the aforementioned ducting of the injector assembly.

The atomiser 9 is of known construction and comprises an atomiser tip 12 at the free end of the casing 8. The atomiser tip 12 has a central discharge opening 13 which is connected by a frusto-conical recess 14 to a series of tangential slots 15. A backplate 16 is held between the end of the pipe 10 and the atomiser tip 12. The backplate 16 has an annular chamber 17 which communicates with the tangential slots 15 and via a plurality of access channels 18 with a reservoir 19. The reservoir 19 is also connected to the duct 11 by a plurality of access channels 20 in the end of the pipe 10.

In the end of the pipe 10 there is an atomiser control valve in the form of a tip sealing valve comprising a first cylindrical portion 21*a* which is slidable in the end of the pipe 10 and a second cylindrical portion 21*b* of smaller diameter which passes through a central clearance hole 22 in the backplate 16. An axial channel 23 extending through the valve 21*a*, 21*b* joins a radial hole 24 near the end 25 of the valve portion 21*b* to provide communication between the interior of the pipe 10 and the frusto-conical recess 14. If liquid fuel under pressure is supplied to the pipe 10 in the direction indicated by the arrow W, the fuel can flow through the channel 23 and the hole 24 to the frusto-conical recess 14, from the recess 14 through the tangential slots 15 to the annular chamber 17, from chamber 17 through the channels 18 to reservoir 19, from reservoir 19 through channels 20 to the annular duct 11 in which the fuel will travel in the direction indicated by the arrows X. The flow of fuel will create hydraulic forces across the tip seal valve 21*a*, 21*b* and cause it to move forward to the position shown in FIG. 3. In this position the end 25 of the valve enters into sealing engagement with the recess 14 to prevent access to the discharge orifice 13. This is the circulate mode of operation of the injector.

Now suppose that the direction of flow of the liquid fuel is reversed, so that fuel under pressure flows in the annular duct 11 in the direction of the arrows Y, as shown in FIG. 4. This fuel flows from the annular duct 11 through the channels 20 to the reservoir 19 and thence through channels 18 to the annular chamber 17. The fuel proceeds through the tangential slots 15 to the frusto-conical recess 14. The pressure of fuel acting on the tip sealing valve portion 21*a* displaces the latter to the right (as viewed in FIG. 4) against the bias of a spring 26, to withdraw the end 25 of the tip sealing valve from the recess 14. Fuel can then issue as an atomised spray from the discharge opening 13. Any surplus fuel passes through the hole 24 and the channel 23 and flows along the pipe 10 in the direction of the arrow Z. This is the discharge mode of the injector, with spill return of fuel through the pipe 10.

Referring to FIG. 2 again, the pipe 10 and the annular duct 11 are connected, respectively, to channels 27 and 28 (shown in dotted lines) in the injector housing 4. With the injector assembly 2 in its correct operational position on the valve housing 1, the channels 27 and 28 communicate, respectively, with channels 29 and 30 (shown in dotted lines) in the valve housing 1. In order to prevent fuel dribbling from the channels 27–30 when the injector assembly 2 is removed from the valve housing, spring-loaded cut-off valves (not shown) may be provided at the surfaces of the housings 1 and 4 which contact one another in the assembled condition of the injector. These cut-off valves would be spring biased to their closed positions and arranged to open automatically when the injector housing 4 is engaged in its correct position on the valve housing 1. When such cut-off valves are provided the valves on one of the housings 1 and 4 may each comprise a cylindrical casing which projects into a fitting bore in the other housing. These casings can then serve the same purpose as the aforementioned pins 7, and these pins can then be omitted.

Control of the direction of flow of liquid fuel in the ducting constituted by the pipe 10 and the annular duct 11 is effected by a change-over valve in the valve housing 1. Referring to FIG. 5, the change-over valve comprises a cylindrical valve member or spool 31 slidable in a cylindrical bore 32 extending from the end 33 to the end 34 of a sub-housing 1*a* forming part of the housing 1. The spool 31 has an end 35 of reduced diameter projecting from the end 33 of the sub-housing 1*a* and, intermediate its ends, the spool has five spaced-apart portions of reduced diameter forming labyrinths 36–40. Intermediate its ends, the bore 32 has six spaced-apart portions of increased diameter forming annular galleries 41–46. An inlet passage 47 for the supply of liquid fuel to the injector passes from the external surface of the housing 1 to the gallery 43, and an outlet passage 48 for exhausting liquid fuel from the injector passes from the external surface of the sub-housing 1*a* to the gallery 41. An internal channel 49 (shown in chain lines) in the sub-housing 1*a* connects the oulet passage 48 to the gallery 45, an internal channel 50 (shown in chain lines) in the sub-housing 1*a* connects the outlet passage 48 via channel 49 to the gallery 46, and an internal channel 51 (shown in chain lines) in the spool 31 connects the labyrinth 38 to the labyrinth 40.

A sub-housing 1*c*, secured to the end 33 of the valve sub-housing 1*a*, surrounds the end 35 of the spool 31. A single-acting, pneumatically-operated piston 65, slidable in a chamber 65*a* within the sub-housing 1*c*, is attached to the end 35 of the spool 31. The spool 31 and the piston 65 are biased to the right (as viewed in FIG. 5) by a spring 66 in the sub-housing 1*c*, the spring 66 being located between a cup 68 slidable in the sub-housing 1*c* and a cup 72 slidable in the sub-housing 1*a*.

A sub-housing 1*b* (see FIGS. 5 and 9), secured to the end 34 of the valve sub-housing 1*a*, supports a shaft 52 for rotation in bearings 53 and 54, the axis of rotation of the shaft 52 being at right angles to the longitudinal axis of the spool 31. Externally of the sub-housing 1*b*, the shaft 52 is secured to a disc 55 of generally frusto-conical shape, but having a segment cut away to form a flat 56 thereon. An operating handle 57 (see FIG. 1) is secured to the disc 55.

A cam 58 is eccentrically mounted on the shaft 52 in such a way as to engage the end 31*a* of the spool 31 and force the spool 31 to adopt the locked position shown in FIG. 5 when the disc 55 is rotated 180° from the position shown in FIG. 9 to that shown in FIG. 1. This locked position of the spool 31 is determined by abutment of a shoulder 70 on the spool 31 against end 71 of the cup 72, by abutment of end 75 of the cup 68 against end 76 of the cup 72 and by abutment of end 67 of the cup 68 against a shoulder 69 in the sub-housing 1*c*. In this locked position of the spool 31 (which is the aforementioned third position of the valve member of the change-over valve) the only flow path available to fuel entering the gallery 43 from the inlet passage 47 is along the channel 51 in the spool 31 to the labyrinth 40, into the gallery 45 and thence via the channel 49 to the outlet passage 48. Fuel cannot therefore reach the injector assembly 2 and the latter is therefore in its isolate mode, with the spool 31 of the change-over valve in its aforementioned third position.

In order to prevent accidental turning of the disc 55, the latter may have a spring-urged plunger (not shown) mounted therein which engages in a hole in the sub-housing 1*b* to lock the disc 55 in the position shown in FIGS. 1 and 9. This plunger can be withdrawn from its locking engagement with the sub-housing 1*b* by means of a knob 77 (see FIG. 1) on the disc 55.

Referring to FIGS. 1 and 9, it will be seen that a tab 59 of the injector housing 4 is positioned between the valve housing 1 and the periphery of the disc 55. When the injector is required to be in its isolate mode (i.e. with the spool 31 of the change-over valve locked in the position shown in FIG. 5), the handle 57 must be rotated to the position shown in FIG. 1. It is only in this position of the handle 57 that the flat 56 of the disc 55 does not interfere with the tab 59. It is therefore impossible to remove the injector assembly 2 from the valve housing 1, unless the former is in its isolate mode.

In FIG. 9 it will be seen that the shaft 52 carries a further cam 60 which controls the position of a plunger 61 which is slidably mounted in the sub-housing 1*b*. In the position of the cam 60 shown in FIG. 9, a valve member 62 of a vent valve is urged by a spring 62*a* to engage a sealing washer 62*b* against a plate 62*c* provided with through holes 62*d*. In this position of the cam 60, the washer 62*b* obturates the holes 62*d* so that the vent valve closes communication between a vent orifice 63 in the sub-housing 1*a* and a channel 64 in the sub-housing 1*a* which communicates with the gallery 44. When the disc 55 is moved to the position shown in FIG. 1 (i.e. to place the injector in its isolate mode) the cam 60 urges the plunger 61 to the left, as viewed in FIG. 9, with the result that the valve member 62 no longer urges the washer 62*b* against the plate 62*c*. The holes 62*d* are therefore no longer obturated by the washer 62*b* and communication is established between the vent orifice 63 and the gallery 44 via the channel 64. From the description hereinafter it will be appreciated that the gallery 44 is connected to the ducting constituted by the pipe 10 and the annular duct 11 in the discharge, circulate and isolate modes of the injector. Consequently, when the injector is set to its isolate mode, any pressure remaining in the injector assembly 2 is vented via the orifice 63 prior to removal of the injector assembly from the valve housing 1.

If the handle 57 is turned through 180° from the position shown in FIG. 1, so that the cam 58 takes up the position shown in FIG. 9, the spring 66 urges the spool 31 to the position shown in FIG. 6, corresponding to the aforementioned circulate mode of the injector. This position of the spool 31 is determined by abutment of the end 71 of the cup 72 on a shoulder 73 in the sub-housing 1*a*.

If, with the cam 58 and the spool 31 in the positions shown in FIG. 6, compressed air is supplied to the chamber 65*a*, the piston 65 forces the spool 31 to move to the right to the position shown in FIGS. 7 and 8. This position of the spool 31, corresponding to the aforementioned discharge mode of the injector, is determined by abutment of the face 74 of the piston 65 against the end 67 of the cup 68, by abutment of the end 75 of the cup 68 against the end 76 of the cup 72 and by abutment of the end 71 of the cup 72 on the shoulder 73 in the sub-housing 1*a*.

A visual indication of whether the injector is in its isolate, circulate or discharge mode may be given by a tell-tale rod 104 slidably mounted in a bore in the sub-housing 1*b* and having its inner end urged into abutment with the end 31*a* of the spool 31 by a spring 105. As shown in FIG. 7, the rod 104 may be linked to electric switch means 109 in circuitry 110 for giving an indicating or control signal at a location remote from the injector.

The injector also comprises a spill return valve to control the quantity of fuel which returns to the valve housing 1 via the pipe 10 when the injector is in its discharge mode (FIG. 4). Referring again to FIG. 5, this spill return valve is mounted in the valve housing 1 and comprises a spool, generally designated by the numeral 78, which is slidable in a hollow cylindrical liner 79. The liner 79 is held in a bore 80 in the valve sub-housing 1*a* between sleeves 81 and 82 which are attached to the ends 33 and 34, respectively, of the sub-housing 1*a*. A helical spring 83 in the sleeve 82 bears against a face 84 of the spool 78 and biases the spool to the left into the position shown in FIG. 7, in which its end 85 bears against the face 86 of a single-acting, pneumatically-actuated piston 87 which is slidable in a chamber 87*a* within the sub-housing 1*c*. The piston 87 is in turn urged to the left, as viewed in FIG. 7, when it is not energised.

The spool 78 comprises a spingle 88 and three spaced-apart portions 89, 90 and 91 of larger diameter than the spindle 88, these portions 89, 90 and 91 being a sliding fit in the liner 79.

The liner 79, as can be seen from FIG. 7, has four annular galleries 92, 93, 94 and 95 formed in its peripheral surface. The gallery 92 communicates with four triangular ports 96 spaced at equal intervals around the liner. The galleries 93 and 94 communicate, respectively, with a set of four circular ports 97 and a set of four circular ports 98, which ports are also spaced at equal intervals around the liner. The gallery 95 communicates with four triangular ports 99 spaced at equal intervals around the liner. The gallery 92 is connected to the aforementioned channel 30 in the sub-housing 1*a*, the gallery 93 is connected by a channel 100 in the sub-housing 1*a* to the gallery 44 of the change-over valve, the gallery 94 is connected by a channel 101 in the sub-housing 1*a* to the gallery 42 of the change-over valve, and the gallery 95 is connected to the aforementioned channel 29 in the housing 1.

When it is desired to change the mode of operation of the injector from its isolate mode (FIGS. 1 and 5) to its circulate mode (FIG. 6), the disc 55 is released from engagement with the sub-housing 1*c* by withdrawal of the knob 77 (FIG. 1) and is then rotated through 180° to the position shown in FIG. 9. The plunger controlled by the knob 77 may re-lock the disc 55 in this position. The edge of the disc 55 overlies the tab 59 of the injector assembly 2 (as shown in FIG. 9) so that the latter cannot be removed from the valve housing 1.

This rotation of the disc 55 moves the cams 58 and 60 to the positions shown in FIG. 9, thus allowing the spool 31 to move to the position shown in FIGS. 6 and 9 under the influence of the spring 66 and allowing the plunger 61 to move to the position shown in FIG. 9, in which the vent valve 62 closes communication between the orifice 63 and the channel 64. In this position of the spool 31, fuel can flow via the inlet passage 47, gallery 43, labyrinth 37, gallery 42 and the channel 101 to the gallery 94 of the spill return valve. The fuel then passes through the ports 98 into the liner 79 and out from the latter through the ports 99 to the gallery 95 which, as previously described, is connected to the channel 29 in the sub-housing 1*a*. The fuel can then flow via the channels 29 and 27 (see FIG. 2) to the pipe 10 of the injector assembly 2, past the atomiser 9 (as described with reference to FIG. 3) into the annular duct 11. From the annular duct 11 and fuel flows through the channels 28 and 30 (see FIG. 2). As previously described, the channel 30 is connected to the gallery 92 of the spill return valve. Consequently, the fuel returning from the injector assembly 2 via the annular duct 11 can flow through the ports 96 into the liner 79, out from the latter through the ports 97 to the gallery 93 and then via the channel 100 to the gallery 44 of the change-over valve. From the gallery 44 the fuel flows via the labyrinth 39 to the gallery 45 and then via the channel 49 to the fuel outlet passage 48. Thus, with the change-over valve in the position shown in FIG. 6, fuel circulates from the inlet passage 47, through the injector assembly 2 and back to the outlet passage 48. The injector is therefore in its circulate mode, and the spool 31 of the change-over valve is in its aforementioned first position.

If now compressed air is supplied to the chamber 65*a*, the piston 65 forces spool 31 to the position shown in FIGS. 7 and 8, as previously described.

With the spool 31 in the positions shown in FIGS. 7 and 8, fuel entering the inlet passage 47 can flow via gallery 43, labyrinth 38, gallery 44, channel 100, gallery 93, into the liner 79 via ports 97, out from the liner 79 via ports 96, into the gallery 92 and thence to the channel 30. The fuel can then flow via the channels 30 and 28 (see FIG. 2) to the annular duct 11 of the injector assembly 2 and thence to the discharge opening 13 of the atomiser 9, as described above with reference to FIG. 4. Surplus fuel spills back along pipe 10 and flows via the channels 27 and 29 to the gallery 95 of the spill return valve. From gallery 95 the fuel passes into the liner 79 via the ports 99 and then passes out of the liner 79 via the ports 98 to the gallery 94 and the channel 101. From channel 101 the fuel passes to the gallery 42 of the change-over valve, via labyrinth 36 to the gallery 41 and thence out through the fuel outlet passage 48. Thus, with the change-over valve in the position shown in FIGS. 7 and 8, fuel flows from the inlet passage 47 to the discharge opening 13 of the atomiser 9 and a proportion of the fuel spills back from the atomiser to the outlet passage 48. The injector is therefore in its discharge mode, and the spool 31 of the change-over valve is in its aforementioned second position.

If, with the injector in the discharge mode, there is a failure of the air supply to the chamber 65*a*, the spool 31 will return automatically to the position shown in FIG. 6, under the influence of the spring 66. The injector then reverts to its circulate mode.

When the spill return valve is in the position shown in FIG. 7, the triangular ports 99 are completely uncovered by the spool portion 89, whereas the ports 96 are partly masked by the spool portion 91. This means that, in the circulate mode of the injector, there is no restriction on the supply of fuel to the channel 101. In the discharge mode, it means that there is a maximum restriction on the flow of fuel to the atomiser 9 via the ports 96, so that the injector operates with a low-rate of fuel discharge at the discharge opening 13 of the atomiser 9.

If compressed air is supplied to the chamber 87*a*, the piston 87 forces the spool 78 to the position shown in FIG. 8 against the influence of the spring 83. The spool portions 89, 90 and 91 then occupy the positions shown in FIG. 8. It will be seen that the ports 99 are now masked and that the ports 96 are unmasked. This means that the injector will operate with maximum fuel flow to the atomiser 9 and no spill return via the ports 99. Consequently, the injector operates with a high rate of fuel discharge at the discharge opening 13 of the atomiser 9.

In the event of failure of the air supply to the chamber 87*a*, the spool 78 is returned by the spring 83 to the position shown in FIG. 7, thus reverting to its low discharge mode.

Clearly, by having a range of spools 78 with spool portions 89 and 91 of different lengths, different ratios of restriction of the ports 96 and 99 can be achieved, to suit the requirements of the user of the injector. For example, by shortening the spool portion 91, it can be arranged that the ports 96 are always fully unmasked, irrespective of the position of spool 78. Again, by shortening the spool portion 89 it can be arranged that the ports 96 are never wholly masked, so that there will always be spill return from the atomiser 9. Furthermore, it is possible to replace the liner 79 by a liner with differently positioned and/or differently shaped ports. For example, the liner may be replaced by one having pear-shaped ports in place of the triangular ports 96 and 99.

The limit of travel of the spool 78 to the right, as viewed in FIG. 8, can be pre-set by varying the position of a screw 102. The limit of travel of the spool 78 to the left, as shown in FIG. 7, can be pre-set by varying the position of a screw 103. A visual indication of the position of the spool 78 may be given by a tell-tale rod 106 slidably mounted in the screw 102 and urged by a spring 107 against an end 108 of the spool 78. As shown in FIG. 8, the rod 106 may be linked to electric switch means 111 in circuitry 112 for giving an indicating or control signal at a location remote from the injector.

Clearly, if a variable pressure air supply is available for energising the piston 87, it would be possible to adjust the spool 78 to positions intermediate the end positions shown in FIGS. 7 and 8.

Although the invention has been described in detail above with reference to a liquid fuel injector, it will be understood that similarly constructed injectors may be employed for controlling the discharge of other fluids.

What is claimed is:

1. A fluid injector comprising a valve housing an injector assembly including discharging means for discharging fluid from the injector assembly, ducting for conveying said fluid between said valve housing and said discharging means and a control valve movable to a first position in response to flow of said fluid in a first direction through said ducting to close said discharging means and return said fluid from said discharging means to said valve housing and movable to a second position in response to flow of said fluid in a second direction through said ducting to open said discharging means to allow at least some of the fluid conveyed to said discharging means to be discharged therefrom and to return any surplus fluid to said valve housing, inlet and outlet passages in said valve housing for conveying said fluid into and from said valve housing, a change-over valve in said valve housing comprising a valve member adjustable into a first position to condition the injector for flow of said fluid from said inlet passage through said ducting in said first direction and into a second position to condition the injector for flow of said fluid from said inlet passage through said ducting in said second direction, and a spill return valve in said valve housing for varying the proportion between the amount of fluid that is allowed to discharge from said discharging means and the amount that is returned from said discharging means to said valve housing when said control valve is in its said second position, said spill return valve comprising a valve member adjustable relative to first and second fluid flow restricting means, whereby both the flow of fluid from the spill return valve to the injector assembly and the flow of fluid from the injector assembly to the spill return valve can be varied simultaneously.

2. A fluid injector according to claim 1, wherein said spill return valve comprises a linearly movable valve member interposed between said change-over valve and said ducting.

3. A fluid injector according to claim 2, wherein said valve member of said spill return valve is movable by pressure fluid-actuated piston and cylinder means.

4. A fluid injector according to claim 3, comprising means biasing said valve member of said spill return valve into a position in which the spill return from said discharging means is a maximum, whereby said valve member of said spill return valve is moved automatically into said maximum spill return position in the event of failure of said piston and cylinder assembly.

5. A fluid injector according to claim 3, wherein said change-over valve comprises a linearly movable valve member actuable into at least one of said first and second positions by pressure fluid-actuated piston and cylinder means.

6. A fluid injector according to claim 5, wherein the axes of the valve members of said change-over valve and said spill return valve are substantially parallel to one another, and said pressure fluid-actuated piston and cylinder assemblies for the two valve members are adjacent one another at one end of said valve housing.

7. A fluid injector according to claim 2, comprising indicator means indicating the position of said valve member of said spill return valve.

8. A fluid injector according to claim 7, wherein said indicator means gives an indication of the position of said valve member of said spill return valve at a location remote from the injector.

* * * * *